United States Patent [19]

Gim

[11] 4,345,712

[45] Aug. 24, 1982

[54] PLASTIC BAG

[76] Inventor: Heung S. Gim, 5389 W. 229th St., Fairview Park, Ohio 44126

[21] Appl. No.: 190,230

[22] Filed: Sep. 24, 1980

[51] Int. Cl.[3] ..... B65D 33/24

[52] U.S. Cl. ..... 229/62; 150/3; 206/390

[58] Field of Search ..... 150/3, 12; 206/390; 229/54 R, 62

[56] References Cited

U.S. PATENT DOCUMENTS

| | | | |
|---|---|---|---|
| 2,749,957 | 6/1956 | Smith | 150/52 R X |
| 3,024,824 | 3/1962 | Bass | 150/52 R |
| 3,441,198 | 4/1969 | Ericson | 150/3 X |
| 3,623,526 | 11/1971 | Robertson | 150/52 R |
| 3,822,806 | 7/1974 | Grimes | 215/11 E |
| 3,961,743 | 6/1976 | Hollowell | 229/62 |

*Primary Examiner*—Donald F. Norton
*Attorney, Agent, or Firm*—James A. Hudak

[57] ABSTRACT

A plastic bag (10) having integral tying means eliminating the need for auxiliary fastening means is disclosed. The walls of the bag are perforated or cut in a generally continuous arc-like configuration adjacent the opening in the bag so as to form fastening ends (16) on the corners of the bag (10). Diagonally opposite fastening ends (16) are joined and tied forming adjacent knots (26) which can be used as a carrying handle (28) for same. The walls of the bag (10) adjacent the bottom thereof are joined by a generally continuous arc-like heat sealed seam causing the bottom of the bag (10) to assume a generally rounded configuration when filled resulting in an evenly distributed load over the seam.

3 Claims, 4 Drawing Figures

PLASTIC BAG

TECHNICAL FIELD

The present invention relates to plastic bags in general, and more particularly to plastic bags having integral tying means and an overall configuration which maximizes bag capacity and handling strength.

DESCRIPTION OF THE PRIOR ART

Typically, plastic bags which are used for holding refuse or other material are manufactured from an extruded tube of plastic, such as polyethylene, which is heat sealed and perforated at spaced intervals along the length of the tube. The tube of plastic is then rolled into a tubular configuration for packaging and sale purposes, and each bag is subsequently individually removed from the roll, as needed, by tearing it off at the perforation. Alternatively, in some instances, the tube of plastic is cut rather than perforated, permitting the bags to be folded and placed into a dispensing container for individual removal therefrom at time of use.

In either case, after the bag has been filled, it must be closed and various means are available for maintaining the bag in a closed condition. Paper covered wire ties or plastic straps are available for use as a closure for such bags, however, the use of these closing means requires that the bag be closed with one hand while the wire tie or plastic strap is applied with the other. This usually proves to be a cumbersome task. In addition, the wire tie or plastic straps are typically stored separately from the bags and are easily misplaced.

To overcome the problem of misplaced closure means, various bags have been designed with integral tying means. The utilization of such integral tying means requires that the user of the bag perform the additional act of removing the integral tying means from the bag before using same. This approach also reduces the usable capacity of the bag.

All of the foregoing problems were reviewed in and were to be remedied by the invention disclosed in U.S. Pat. No. 3,961,743 which teaches the use of an integral pair of ears on a plastic bag in order to provide a means for closing same. After the bag has been filled, the ears are brought together and tied closing the bag and forming a carrying handle for same. One of the inherent disadvantages of the bag disclosed in this patent is that only two ears, each being relatively narrow throughout its entire length, are available for tieing purposes. Thus, the ears can easily tear during the tying process or when being used as a carrying handle. In addition, since only two ears are utilized, the wide mouth portion of the bag between the ears remains open permitting the contents of the bag to possibly overflow when in the tied condition. Furthermore, inasmuch as the relatively narrow ears also determine the configuration of the bottom portion of the adjacent bag on the roll, the bottom portion of each bag has an extremely long seam and contains corners which typically remain unfilled or partially filled during the filling process resulting in a bag which, in general, is not filled to its theoretical capacity. And lastly, the invention taught by this patent is difficult to manufacture due to the long narrow ears and because the design requires the transverse shifting of one layer of plastic relative to the other layer of plastic forming the bag so that the tying ears can be formed.

Thus, the invention disclosed in this patent is expensive to manufacture, process, and package.

Because of the foregoing, it has become desirable to develop an inexpensive, easily manufactured plastic bag which can be closed by a plurality of integral fastening ends, each having a high tear strength, and which can be tied to form a carrying handle for same.

SUMMARY OF THE INVENTION

The present invention solves the aforementioned problems associated with the prior art as well as other problems by providing a plastic bag having deep gussets in which are formed integral fastening ends. After the bag has been filled, each pair of diagonally opposite fastening ends is joined and tied forming adjacent knots which are used as a carrying handle. The bags are typically manufactured from an extruded tube of plastic which is heat sealed and perforated or cut at preset specified intervals along the length of the tube. A generally arc-like configuration is utilized for the heat sealed seam and the adjacent perforation forming the fastening ends which have a relatively substantial width for most of their length. This substantial width of the fastening ends increases the overall tear strength of the bag closure. The generally arc-like configuration for the heat sealed seam and perforation results in a bag with a generally rounded bottom with no wasted corners, and which can be filled to its theoretical capacity. This generally rounded configuration for the bottom of the bag also results in a more evenly distributed load over the heat sealed seam, increasing the overall tear strength of the bag.

In view of the foregoing, it will be seen that one aspect of the present invention is to provide a plastic bag which can be easily closed and fastened by the use of integral fastening ends eliminating the need for auxiliary tying means.

Another aspect of the present invention is to provide a plastic bag which has a relatively high tear strength.

A yet another aspect of the present invention is to provide a plastic bag which does not have corners which can remain unfilled or partially filled during the filling process.

A further aspect of the present invention is to provide a plastic bag which, after being closed and fastened, can be easily reopened.

A still further aspect of the present invention is to provide a plastic bag which can be easily and inexpensively manufactured.

These and other aspects of the present invention will be more clearly understood after a review of the following description of the preferred embodiment when considered with the drawings.

DESCRIPTION OF THE PREFERRED EMBODIMENT

Figure 1:
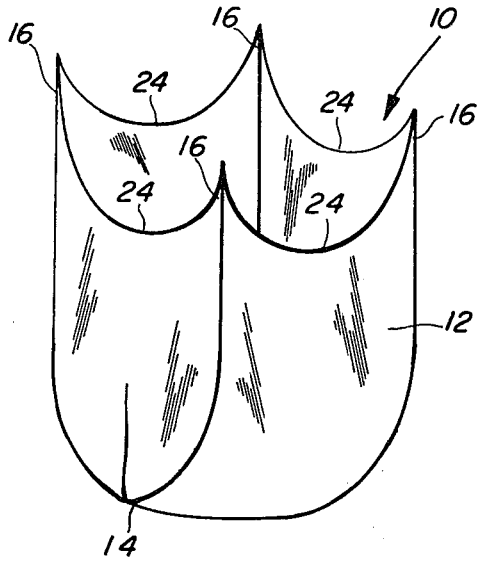
FIG. 1 is a perspective view of the invention of this disclosure after it has been removed from the dispensing roll or container and opened.
Figure 2:
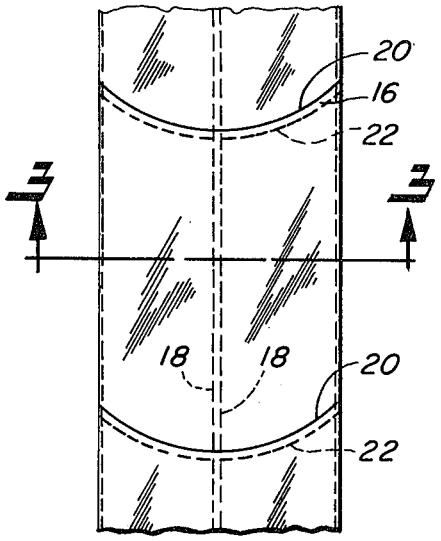
FIG. 2 is a fragmentary plan view of the extruded tube of plastic and illustrates the location and shape of the heat sealed seam and the perforation adjacent thereto.
Figure 3:
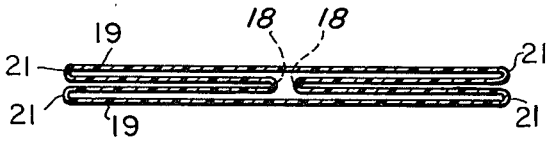
FIG. 3 is a cross-sectional view of the extruded tube of plastic taken along section-indicating lines 3—3 of FIG. 2 and illustrates the location and depth of the gussets.

Referring now to the drawings where the illustrations are for the purpose of describing the preferred embodiment of the invention and are not intended to limit the invention hereto, FIG. 1 is a perspective view of a bag 10 after it has been expanded to be in the open condition. The bag 10 is generally comprised of a body portion 12, a bottom portion 14 and a plurality of fastening ends 16 extending from the body portion 12. The bag 10 is formed from an extruded tube of plastic material, shown in FIG. 2, which is expanded prior to use to form the bag configuration illustrated in FIG. 1. After extrusion, the sides of the tube are folded inwardly forming gussets 18 whose bottom portions are generally parallel to the longitudinal axis of the extruded tube. In this manner, adjacent layers 19 of the tube are located on either side of the gussets 18, as illustrated in FIG. 3. These gussets 18 are approximately equal in width in the transverse direction causing the longitudinal edges 21 of the adjacent layers 19 to be in register. Generally, these gussets 18 are relatively deep in the transverse direction, so that the cross-sectional shape of the bag 10, when in the expanded condition, is approximately square. Other gusset configurations are possible provided that the gussets are relatively deep in the transverse direction so that a plurality of fastening ends are formed during the perforating or cutting process, hereinafter described.

The extruded tube of plastic material is heat sealed forming seams 20, and perforated, as shown by the numeral 22, at spaced intervals along the length of the extruded tube. In the alternative, the extruded tube of plastic material can be cut rather than perforated adjacent each seam 20 producing the individual bags 10. A generally continuous arc-like configuration is used for each heat sealed seam and perforation or cut which results in the formation of the fastening ends 16 on the corners of the bag 10. Because of the deep gussets 18, these fastening ends 16 are located approximately equidistantly around the periphery of the bag 10. In addition, because of these deep gussets 18 and the generally continuous arc-like configuration for the perforation or cut, the fastening ends 16 have relatively substantial width for most of their length. This relatively substantial width for the length of the fastening ends 16 provides tear strength to the resulting closure of the bag 10, as will be hereinafter described.

The use of generally continuous arc-like configuration for the heat sealed seam 20 results in the bag 10, when in the expanded condition, having a rounded bottom portion 14 with no wasted space at the junction of the bottom portion 14 and the body portion 12 of the bag 10. Thus, the bag can be filled to its theoretical capacity whereas the bags of the prior art cannot be so filled since they are heat sealed such that corners result at the junction of the bottom portion with the body portion of the bag. These corners typically remain unfilled or partially filled as refuse is being added to the prior art bags. In addition, since the bottom portion 14 of the bag 10 assumes a generally rounded configuration when filled, the load within the bag 10 is more evenly distributed over the heat sealed seam 20 on the bottom portion 14 thereof, thus increasing the overall tear strength of the bag 10.

After the extruded tube of plastic material is heat sealed and perforated, the tube is rolled into a tubular form, and each bag 10 can be removed therefrom, as needed, by tearing on the perforation 22 so that the heat sealed seam 20 forms the bottom of the bag 10 being removed from the roll. The starting end of the roll will have the same configuration as that of the perforation 22 but no heat sealed seam will be present. Each time a bag is removed from the roll, the next bag will be formed with the proper configuration for the fastening ends 16 thereof. Alternatively, if the extruded tube of plastic material is heat sealed and cut, rather than perforated, the resulting bags 10 can be folded and placed in a dispenser box (not shown) for individual dispensing therefrom as needed.

Figure 4:
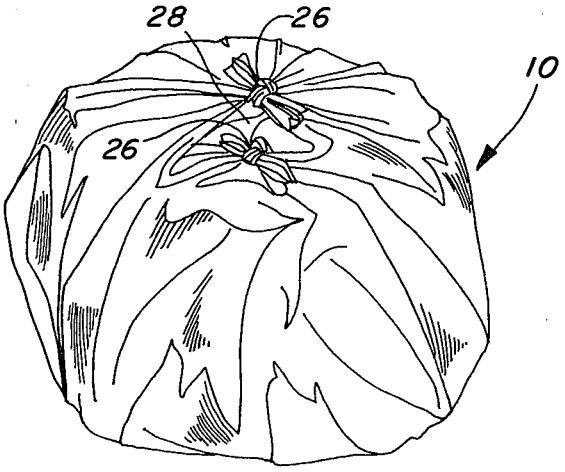
FIG. 4 is a perspective view of the bag after the diagonally opposite fastening ends have been joined together and tied forming a carrying handle for same.

After the bag 10 has been filled with refuse, each pair of diagonally opposite fastening ends 16 is then brought together and tied in a knot resulting in adjacent knots 26 making the bag 10 securely closed, as shown in FIG. 4. The tying process draws the mouth portions 24 of the bag inwardly preventing refuse from falling out of the closed bags. The diagonally tied fastening ends prevent the bag from opening and the knots 26 can be used as a carrying handle 28 for the bag 10. The use of diagonally opposite fastening ends 16 tied in a plurality of knots 26 greatly increases the tear strength of the carrying handle 28 and minimizes the possibility of the bag 10 accidently opening after being closed. In addition, the use of a plurality of fastening ends 16, each being of relatively substantial width, greatly increases the tear strength of the bag 10 and minimizes the possibility of the bag tearing when being handled. And lastly, the use of a plurality of fastening ends 16, each having a relatively substantial width, minimizes the possibility of material falling out of the mouth portions 24 of the bag.

Certain modifications and improvements will occur to those skilled in the art upon reading the foregoing description. It will be understood that all such improvements and modifications have been deleted herein for the sake of conciseness and readability but are properly within the scope of the following claims.

I claim:

1. A bag formed from a tubular strip of material comprising a body portion having a four-sided configuration with an opening at one end thereof, said body portion being formed by adjacent layers of the tubular strip of material, the respective longitudinal edges of said adjacent layers being in register the material between said adjacent layers being tucked inwardly to form two inward folds with one of said adjacent layers on opposite sides thereof, and a bottom portion integrally formed to said body portion at the other end thereof, said opening being defined by a generally arc-like cut in each surface defining the four sides of said body portion, said arc-like cut being continuous on each surface defining said four sides of said bag forming fastening ends at the junction of those of said surfaces that are adjacent, the length of said fastening ends being sufficient to permit diagonally opposite fastening ends to be brought together and tied forming a carrying handle for same.

2. The plastic bag as defined in claim 1 wherein said surfaces are heat sealed at said other end of said bag to close said bottom portion of said bag, the heat sealed seam formed having a generally arc-like configuration similar to said arc-like cut in said surfaces at said one end of said bag.

3. The plastic bag as defined in claim 2 wherein said surfaces defining said body portion are perforated adjacent said heat sealed seam permitting the removal of said bag from a dispensing roll or container, said perforation having a generally arc-like configuration similar to said heat sealed seam so as to form said generally arc-like perforation in said surfaces at said one end of the adjacent bag on said tubular strip of material.

* * * * *